US007722930B2

(12) United States Patent
Shimoda et al.

(10) Patent No.: US 7,722,930 B2
(45) Date of Patent: May 25, 2010

(54) METHOD AND APPARATUS FOR DRYING COATED FILM

(75) Inventors: Kazuhiro Shimoda, Odawara (JP); Nobuo Hamamoto, Odawara (JP); Yasunaga Harabe, Odawara (JP)

(73) Assignee: FUJIFILM Corporation, Tokyo (JP)

( * ) Notice: Subject to any disclaimer, the term of this patent is extended or adjusted under 35 U.S.C. 154(b) by 128 days.

(21) Appl. No.: 11/971,516

(22) Filed: Jan. 9, 2008

(65) Prior Publication Data

US 2008/0187656 A1 Aug. 7, 2008

(30) Foreign Application Priority Data

Jan. 10, 2007 (JP) ..... 2007-002501
Feb. 23, 2007 (JP) ..... 2007-044670

(51) Int. Cl.
*B05D 3/04* (2006.01)

(52) U.S. Cl. ..... 427/378; 427/385.5

(58) Field of Classification Search ..... None
See application file for complete search history.

(56) References Cited

U.S. PATENT DOCUMENTS 5,853,801 A 12/1998 Suga et al.
2005/0233082 A1 * 10/2005 Ogawa ..... 427/314
2008/0075867 A1 * 3/2008 Hamamoto ..... 427/377

FOREIGN PATENT DOCUMENTS

JP 9-73081 A 3/1997
JP 2001-170547 A 6/2001
JP 2005-081256 * 3/2005

* cited by examiner

*Primary Examiner*—Erma Cameron
(74) *Attorney, Agent, or Firm*—Sughrue Mion, PLLC

(57) ABSTRACT

In a drying method of an aspect of the present invention, drying steps are conducted immediately after coating in a drying zone, and during the execution of drying by blowing the one-way flow drying wind flowing from one edge side to another edge side in the width direction of the continuous support, the windless drying step is conducted in a windless drying zone provided in the drying zone where the drying wind is not blown.

8 Claims, 11 Drawing Sheets

PRIOR ART

FIG.6

| | WIND DIRECTION IN THE DRYING APPARATUS | COATING AMOUNT (ml/m$^2$) | LENGTH OF THE WINDLESS ZONE (mm) | LENGTH OF THE FIRST DRYING WIND ZONE (mm) | DESICCATION WIND VELOCITY (m/s) | | UNEVENNESS OF COATED FILM | | |
|---|---|---|---|---|---|---|---|---|---|
| | | | | | THE FIRST DRYING WIND ZONE | THE SECOND DRYING WIND ZONE | BROAD UNEVENNESS A | SHARP UNEVENNESS B | TOTAL EVALUATION |
| COMPARATIVE EXAMPLE 1 | FIG. 5A | 5 | – | – | 0.5 | 0.2 | C | A | C |
| EXAMPLE 1 | FIG. 5B | 5 | 20 | 200 | 0.5 | 0.2 | A | A | A |
| EXAMPLE 2 | FIG. 5B | 5 | 80 | 200 | 0.5 | 0.2 | A | A | A |
| EXAMPLE 3 | FIG. 5B | 5 | 200 | 200 | 0.5 | 0.2 | A | A | A |
| EXAMPLE 4 | FIG. 5B | 5 | 1000 | 200 | 0.5 | 0.2 | A | A | A |
| COMPARATIVE EXAMPLE 2 | FIG. 5B | 5 | 1600 | 200 | 0.5 | 0.2 | A | C | C |
| EXAMPLE 5 | FIG. 5B | 5 | 800 | 80 | 0.5 | 0.2 | A | A | A |
| EXAMPLE 6 | FIG. 5B | 5 | 800 | 1600 | 0.5 | 0.2 | A | A | A |
| COMPARATIVE EXAMPLE 3 | FIG. 5B | 5 | 800 | 2000 | 0.5 | 0.2 | A | C | C |
| EXAMPLE 7 | FIG. 5B | 5 | 800 | 200 | 0.3 | 0.2 | B | A | A |
| COMPARATIVE EXAMPLE 4 | FIG. 5B | 5 | 800 | 200 | 0.2 | 0.2 | C | A | C |
| EXAMPLE 8 | FIG. 5B | 5 | 800 | 200 | 0.6 | 0.2 | A | A | A |
| COMPARATIVE EXAMPLE 5 | FIG. 5B | 5 | 800 | 200 | 0.7 | 0.2 | A | C | C |
| EXAMPLE 9 | FIG. 5B | 5 | 800 | 200 | 0.5 | 0.3 | A | B | B |
| EXAMPLE 10 | FIG. 5B | 5 | 800 | 200 | 0.5 | 0.4 | A | C | A |
| EXAMPLE 11 | FIG. 5B | 7 | 1000 | 200 | 0.5 | 0.2 | A | A | A |

COATING LIQUID COMPOSITION

FIG.7

| CONTENTS OF COMPOSITIONS | | | COMPARATIVE EXAMPLE 2 | COMPARATIVE EXAMPLE 3 | EXAMPLE 16 | EXAMPLE 17 |
|---|---|---|---|---|---|---|
| | | | ADDITION AMOUT (kg) | ADDITION AMOUT (kg) | ADDITION AMOUT (kg) | ADDITION AMOUT (kg) |
| SOLVENT | MEK | | 102.00 | 102.00 | 102.00 | 102.00 |
| SOLID CONTENT | DISCOTIC LIQUID CRYSTALLINE COMPOUND | | 41.01 | 41.01 | 41.01 | 41.01 |
| | ETHYLENE OXIDE MODIFIED TRIMETHYLOL BOROBAMN ACRYLATE | VISCOAT #360 AVAILABLE FROM OSAKA ORGANIC CHEMICAL INDUSTRY LTD. | 4.06 | 4.06 | 4.06 | 4.06 |
| | PHOTOINITIATOR | IRGACURE#907 AVAILABLE FROM CIBA GEIGY JAPAN CO.,LTD. | 1.35 | 1.35 | 1.35 | 1.35 |
| | SENSITIZER | KAYACURE DETE AVAILABLE FROM NIPPON KAYAKU | 0.45 | 0.45 | 0.45 | 0.45 |
| | CELLULOSEACETATEBUTYLATE | CAB551-0.2 AVAILABLE FROM EASTMAN CHEMICAL COMPANY | 0.34 | 0.34 | 0.34 | 0.34 |
| | CELLULOSEACETATEBUTYLATE | CAB531-1 AVAILABLE FROM EASTMAN CHEMICAL COMPANY | 0.11 | 0.11 | 0.11 | 0.11 |
| | COPOLYMER CONTAINING FLUORO ALIPHATIC GROUP WITH ACIDIC GROUP | COMPOUND (P-0) | - | 0.05 | 0.25 | 0.15 |
| | COPOLYMER CONTAINING FLUORO ALIPHATIC GROUP | COMPOUND (P-1) | - | 0.05 | - | - |
| | COPOLYMER CONTAINING FLUORO ALIPHATIC GROUP | COMPOUND (P-2) | 0.35 | - | - | - |
| | COPOLYMER CONTAINING FLUORO ALIPHATIC GROUP | COMPOUND (P-3) | - | - | 0.25 | - |
| | COPOLYMER CONTAINING FLUORO ALIPHATIC GROUP | COMPOUND (P-4) | - | - | - | 0.15 |

FIG.8

| | | C6 MONOMER TERMINAL STRUCTURE | C6 MONOMER (% BY MASS) | ALL F MONOMERS (% BY MASS) | COATING LAPSETIME (MILLISECOND) | | | SURFACE TENSION RATIO (10 MILLISECOND/ 1000 MILLISECOND) | APPEARANCE CHARACTERISTIC |
|---|---|---|---|---|---|---|---|---|---|
| | | | | | 10 | 100 | 1000 | | |
| EXAMPLE 16 | P-3 | ωF | 50 | 40 | 25.0 | 22.5 | 21.9 | 1.1 | A |
| EXAMPLE 17 | P-5 | ωF | 50 | 35 | 23.9 | 21.7 | 21.1 | 1.1 | A |
| COMPARATIVE EXAMPLE 2 | P-2 | ωF | 100 | 40 | 28.2 | 22.5 | 20.8 | 1.4 | C |
| COMPARATIVE EXAMPLE 3 | P-1 | ωH | 100 | 90 | 25.6 | 23.0 | 22.6 | 1.1 | C |
| COMPARATIVE EXAMPLE 4 | P-6 | ωF | 0 | 38 | 28.4 | 23.7 | 22.0 | 1.3 | C |
| COMPARATIVE EXAMPLE 5 | P-7 | ωF | 0 | 36 | 28.1 | 25.8 | 21.9 | 1.3 | C |

※ C6 MONOMER(MASS):COMPOSITION RATIO IN POLYMER CONTAINING FLUORINE ATOM··· C6/(C4+C6)

※ ALL F MONOMERS(MASS):ALL FLUORINE COMPONENT RATIO IN POLYMER CONTAINING FLUORINE ATOM ··· (C4+C6)/(C4+C6+NON-FLUORINE POLYMER)

FIG.9

| | POLYMER CONTAINING FLUORINE ATOM | FLUORINE ATOM EXISTING RATIO | | | APPEARANCE CHARACTERISTIC |
|---|---|---|---|---|---|
| | | DISTANCE FROM COATED FILM AIR INTERFACE (nm) | | | |
| | | 10 | 100 | 1000 | |
| EXAMPLE 16 | P-3 | 25.0 | 22.5 | 21.9 | A |
| COMPARATIVE EXAMPLE 2 | P-2 | 28.2 | 22.5 | 20.8 | C |
| COMPARATIVE EXAMPLE 3 | P-1 | 25.6 | 23.0 | 22.6 | C |

METHOD AND APPARATUS FOR DRYING COATED FILM

BACKGROUND OF THE INVENTION

1. Field of the Invention

The present invention relates to a method and an apparatus for drying a coated film. More particularly, it relates to a method and an apparatus for drying a surface of a wide and long continuous coated film formed by applying a coating liquid containing an organic solvent over a continuous support in a preparation process of an optical compensation film, etc.

2. Description of the Related Art

In order to improve viewing angle characteristics in a liquid crystal display device, an arrangement of an optical compensation film as a phase difference plate between a pair of polarizing plates and a liquid crystal cell has been adopted. For preparing the continuous optical compensation film, steps of applying a coating liquid containing a resin for forming an orientation film over a surface of continuous transparent film and forming the orientation film by subjecting to a rubbing treatment are carried out. Subsequently, applying a coating liquid containing a discotic liquid crystalline compound on the orientation film to form a coated layer and drying the coated layer are disclosed (see Japanese Patent Application Laid-Open No. 9-73081).

The drying method for the coating liquid containing the discotic liquid crystalline compound disclosed in the Japanese Patent Application Laid-Open No. 9-73081 employs an initial drying under a room air conditioning condition after applying the coating liquid containing the discotic liquid crystalline compound on the orientation film and before drying by means of a regular drying apparatus. In the initial drying, organic solvents in the coating liquid are mainly vaporized before drying.

However, in the optical compensation film prepared by the preparation method described in the Japanese Patent Application Laid-Open No. 9-73081, there is a problem that two kinds of unevenness (mottles) A and B which are illustrated in FIG. 10 such as a broad unevenness A (shown as thin lines) and a sharp unevenness B (shown as bold lines) occur on the surface of the coated film 101 in the initial drying step thereby decreasing the yield of the product depending on the cases.

As a result of analyzing those two kinds of unevenness A and B, it was clarified that the broad unevenness A reveals when the thickness of a film 102 layer of the coated liquid containing a discotic liquid crystalline compound becomes thin as shown in FIG. 11. In FIG. 11, a numerical code 103 illustrates a continuous support and a numerical code 104 illustrates an orientation film layer. On the other hand, it was clarified that an orientation direction 106 in an orientation part 105 (dense color part) where the sharp unevenness B is occurring deviates from an orientation part 108 of other normal orientation direction 107 as shown in FIG. 12.

A countermeasure generally executed as effective measures against those unevenness A and B which occur in the initial drying is to increase a viscosity of the coating liquid by elevating a concentration of the coating liquid or by adding a thickener. The countermeasure is a method of preventing the occurrences of unevenness by suppressing a fluid flow of the surface of the coated film induced by the drying wind immediately after coating. Another method is a method of preventing the occurrences of unevenness by causing a leveling effect with the usage of an organic solvent having high boiling point despite a generation of the fluid flow of the surface of the coated film induced by the drying wind immediately after coating.

However, to increase the viscosity of the coating liquid by elevating the concentration of the coating liquid or by adding the thickener has shortcomings failing to achieve super thin layer precise coating for forming a coated film of super thin layer by high-speed coating. Further, because the thicker increases the viscosity of the coating liquid, the lower a threshold coating velocity (threshold of the coating velocity capable of stable coating) falls, a high-speed coating becomes impossible with the increase of viscosity and accordingly, there is also a shortcoming that a production efficiency turns worse furiously.

On the other hand, the usage of an organic solvent having high boiling point induces augmentation of drying time and augmentation of amount of residual solvent remaining in the coated film thereby requiring much drying time and accordingly, there is also a shortcoming that the production efficiency turns worse.

From such a background, inventors of the present invention already proposed a method and apparatus for drying coated film described in Japanese Patent Application Laid-open No. 2001-170547. The method and apparatus provides a technology in which disposing a drying zone immediately after the coating, together with surrounding a surface of the coated film to be dried of the traveling continuous support, and generating a one-way flow drying wind flowing from one edge side to another edge side in a width direction of the continuous support resultantly achieving uniformly drying the coated film without changing the property such as viscosity and so on or the kinds of the solvent. The method and apparatus for drying the coated film is estimated as capable of suppressing the above occurrences of unevenness.

SUMMARY OF THE INVENTION

However, because higher and higher quality is required as quality of the optical compensation film in these days, suppression of unevenness in the method and apparatus for drying coated film proposed in Japanese Patent Application Laid-open No. 2001-170547 is not sufficient and further improvement is desired.

Taking the above problems into consideration, the object of the present invention is to provide a method and apparatus for a coated film capable of conspicuously suppressing occurrences of unevenness having a tendency of occurring in an initial drying stage immediately after coating and further, capable of uniformly drying the coated film without changing the property such as viscosity and so on or the kinds of the solvent.

To achieve the above object, a first aspect of the present invention provides a drying method for a coated film formed by applying a coating liquid containing an organic solvent over a traveling continuous support, the method which sequentially conducts, immediately after the application, following steps in a drying zone where a coated surface to be dried of the traveling continuous support is surrounded: a first drying step for drying the surface of the coated film by conveying the continuous support through the first drying wind zone in which an one-way flow drying wind, flowing from one edge side to another edge side in a width direction of the continuous support, is supplied; a windless drying step for drying the surface of the coated film by conveying the continuous support through a windless drying zone in which the drying wind is not blown; and a second drying step for drying the surface of the coated film by conveying the continuous support through the second drying wind zone in which supplies an one-way flow drying wind, flowing from one edge side to another edge side in a width direction of the continuous support, is supplied.

According to the first aspect, deploying the drying zones immediately after coating, during the execution of drying by blowing the one-way flow drying wind flowing from one edge side to another edge side in the width direction of the continuous support, the windless drying step is provided by disposing the windless drying zone in which the drying wind is not blown among the drying zones. In the first drying step of the initial drying, much organic solvent remains in the surface of the coated film and because a fluctuation induced by distribution of the organic solvent evaporated from the surface of the coated film easily generates, the fluctuation promotes occurrences of unevenness. Accordingly in the first drying step, quickly removing the evaporated organic solvent from the surface of the coated film by blowing the one-way direction drying wind will suppress the occurrences of unevenness.

However, a continuation of blowing the drying wind onto the surface of the coated film as is the situation that the drying rate became slow as a result of reduction in a concentration of the organic solvent in the coated film among the first drying step, it makes a cause of the occurrences of unevenness on the contrary. Therefore, once executing the windless drying step without supplying the drying wind at all after the first drying step, and subsequently drying by blowing the one-way drying wind onto the surface of the coated film again can suppress the occurrences of unevenness through whole drying zones.

A second aspect of the present invention provides the drying method for a coated film according to the first aspect, wherein the windless drying step is conducted at a location encompassing a drying status changing point where a drying status of the coated film changes from a constant rate drying period into a reducing rate drying period.

The second aspect teaches at what timing is the windless drying step preferably executed through the whole drying zone, and it is preferable to be disposed at the drying status changing point where the drying status of the coated film changes from the constant rate drying period into the reducing rate drying period. The disposition can suppress the occurrences of the unevenness in the drying of the coated film all the more.

A third aspect of the present invention provides the drying method for a coated film according to the first aspect, wherein the windless drying step is conducted at a location where an amount of solids content among the coated film being dried in the above drying zone is 60 to 80% by mass.

The third aspect teaches another embodiment of at what timing is the windless drying step preferably executed through the whole drying zone, and it is preferable to be disposed at the position where an amount of solids content among the coated film being dried in the above drying zone is 60 to 80% by mass. The disposition means that the drying status changing point locates in the range where the amount of solids content among the coated film is 60 to 80% by mass. Accordingly, measuring the amount of the solid contents by experimental drying clarifies at what position in the drying zone the windless drying step is preferably executed.

A fourth aspect of the present invention provides the drying method according to the first aspect, wherein a length of the first drying wind zone is from 80 to 1600 mm along the traveling direction of the continuous support, and wherein a length of the windless zone is from 20 to 1000 mm along the traveling direction of the continuous support.

The fourth aspect teaches still other embodiment of at what timing is the windless drying step preferably executed through the whole drying zone, and because both the length of the first drying wind zone and the length of the windless zone are settled as the above description, the above drying status changing point can be positioned among the windless drying step.

A fifth aspect of the present invention provides the drying method for a coated film according to any one of the first to fourth aspects, wherein an averaged wind velocity of the drying wind among the first drying step is from 0.3 to 0.6 m/s, and wherein an averaged wind velocity of the drying wind among the second drying step is from 0.1 to 0.3 m/s.

In accordance with the fifth aspect, because the averaged wind velocity of the drying wind among the second drying step is smaller than the averaged wind velocity of the drying wind among the first drying step, the occurrences of the unevenness are suppressible all the more.

A sixth aspect of the present invention provides the drying method for a coated film according to any one of the first to fifth aspects, wherein the coated film to be dried is a coated film by applying a coating liquid for a liquid crystal layer which is coated on the orientation film being already subjected to the rubbing treatment in the preparation process for the optical compensation film.

The drying method of the present invention is particularly effective in the drying of the coated film on the continuous support formed after applying the coating liquid for the liquid crystal layer over the orientation film which is subjected to the rubbing treatment.

A seventh aspect of the present invention provides the drying method for a coated film according to any one of the first to sixth aspects, wherein the coating liquid contains a following polymer (i) containing fluoro aliphatic group with a repetition unit introduced from monomers, and wherein the polymer containing fluoro aliphatic group satisfies the following condition (ii):

(i) a polymer which comprises a first monomer containing fluoro aliphatic group whose terminal structure is expressed with —$(CF_2CF_2)_3F$ and the second monomer containing fluoro aliphatic group whose terminal structure is expressed with —$(CF_2CF_2)_2F$; and (ii) a surface tension ratio of the coating liquid measured at both 10 milliseconds and 1000 milliseconds after coating (surface tension at 10 milliseconds after coating/surface tension at 1000 milliseconds after coating) in accordance with a maximum bubble pressure method is from 1.00 to 1.20 when a product of C times F is from 0.05 to 0.12 wherein C represents a concentration of the polymer containing fluoro aliphatic group in the coating liquid with a unit of % by mass and wherein F represents a fluorine content in the polymer containing fluoro aliphatic group with a unit of %.

The seventh aspect adds the above polymer (i) containing fluoro aliphatic group with the repetition unit of the monomers and satisfying the above condition (ii) into the coating liquid. The above composition makes the polymer containing fluoro aliphatic group to move quickly toward air interface of the coating liquid in the initial drying after coating and stabilizes a coated film-air interface, resultantly suppressing occurrences of drying unevenness despite the high-speed drying under the condition of increasing the coating amount and easily revealing the drying unevenness. Further, when the product of C times F is smaller than 0.05, control of liquid crystal compound at air interface is not sufficient and there is a problem that the appearance characteristic (an extent of unevenness) of the optical film becomes worse. When it exceeds 0.12, a coating condition of applying a composition having liquid crystalline property over the transparent support is insufficient and there is a problem that the appearance characteristic of the optical film becomes worse (a repelling defect occurs). When the product of C times F is within the above range, the above problems disappear and the unevenness in the initial drying can be further alleviated.

Additionally, the surface tension ratio of the above term (ii) is a value mainly at room temperature (25° C.), and the surface tension of the coating liquid can be measured in accordance with a maximum bubble pressure method by means of a dynamic surface tension measuring instrument (MPT2: manufactured by LAUDA). Moreover, it is more preferable that a coating amount of the coating liquid is from 5.0 to 6.4 mL/$m^2$. Additionally, the term "maximum bubble pressure method" means a method of measuring the surface tension from the maximum pressure in an occasion of widening an interface between the liquid and the gas by blowing up a bubble by ejecting nitrogen gas from a capillary inserted into the liquid.

An eighth aspect of the present invention provides the drying method for a coated film according to any one of the first to seventh aspects, wherein a fluorine atom existing ratio (F/C) of the coated film measured in accordance with ESCA method at a position of 10 nm in a depth direction from an air interface of the coated film is from 2 to 10 in a case where the fluorine atom existing ratio (F/C) is defined as 100 at the air interface.

In accordance with the eighth aspect, a coated film with superior appearance characteristic can be formed because fluorine concentration is high at the surface of the coated film, and further, fluorine exists even among the coated film.

To achieve the above object, a ninth aspect of the present invention provides, a drying apparatus for a coated film formed by applying a coating liquid containing an organic solvent by means of a coating device over a traveling continuous support, the drying apparatus comprising: a main drying apparatus which is disposed immediately after the coating device to form a drying zone surrounding a surface of the coated film to be dried of the traveling continuous support; the first drying wind zone formed at former half of the drying zone and having an one-way air flow generating device which generates a drying wind flowing from one edge side to another edge side in a width direction of the continuous support; a second drying wind zone formed at latter half of the drying zone and having an one-way air flow generating device which generates a drying wind flowing from one edge side to another edge side in a width direction of the continuous support; a windless zone formed between the first drying wind zone and the second drying wind zone and which does not blow the drying wind; and partition boards which divide the drying zone into the first drying wind zone, the second drying wind zone, and the windless zone each other or respectively.

According to the ninth aspect, the first drying wind zone having the one-way air flow generating device which generates the drying wind formed at former half of the drying zone being formed in the main drying apparatus is provided and then, the windless zone which does not blow the drying wind is provided. Accordingly, supplying wind at initial stage of drying where sufficient organic solvent exists enables early drying. Moreover, in an occasion that drying advances and the organic solvent decreases, a distribution of drying rate enlarges so that the unevenness easily occurs. Therefore, reduction of drying rate by not supplying wind will suppress the occurrences of the unevenness.

Further, next to the windless zone, the second drying wind zone having the one-way air flow generating device which generates the drying wind is provided. After the coated film passes through the windless zone, the distribution of the drying rate diminishes and accordingly, the drying rate become possible to be enhanced by supplying the drying wind in the second drying zone. Moreover, because each zone is divided by means of the partition boards, the drying wind flows from one edge side to another edge side among each zone without flowing into another zones. Therefore, the one-way drying wind can be supplied.

According to the present invention, by adjusting a supply position of the drying wind during drying step and a wind velocity, unevenness occurring among an initial drying stage immediately after coating becomes suppressible thereby enabling a uniform drying.

BRIEF DESCRIPTION OF THE DRAWINGS

FIG. 3 is a view schematically showing a process for preparing a continuous optical compensation film, wherein a drying apparatus of the present invention is built in;

FIG. 6 is a table showing evaluation results of the examples;

FIG. 7 is a table showing evaluation results of the examples;

FIG. 8 is a table showing evaluation results of the examples;

FIG. 9 is a table showing evaluation results of the examples;

DETAILED DESCRIPTION OF THE PREFERRED EMBODIMENTS

Preferred embodiments of the method and apparatus for drying a coated film in the present invention will be explained in detail as follows with reference to the accompanied figures.

Figure 1:
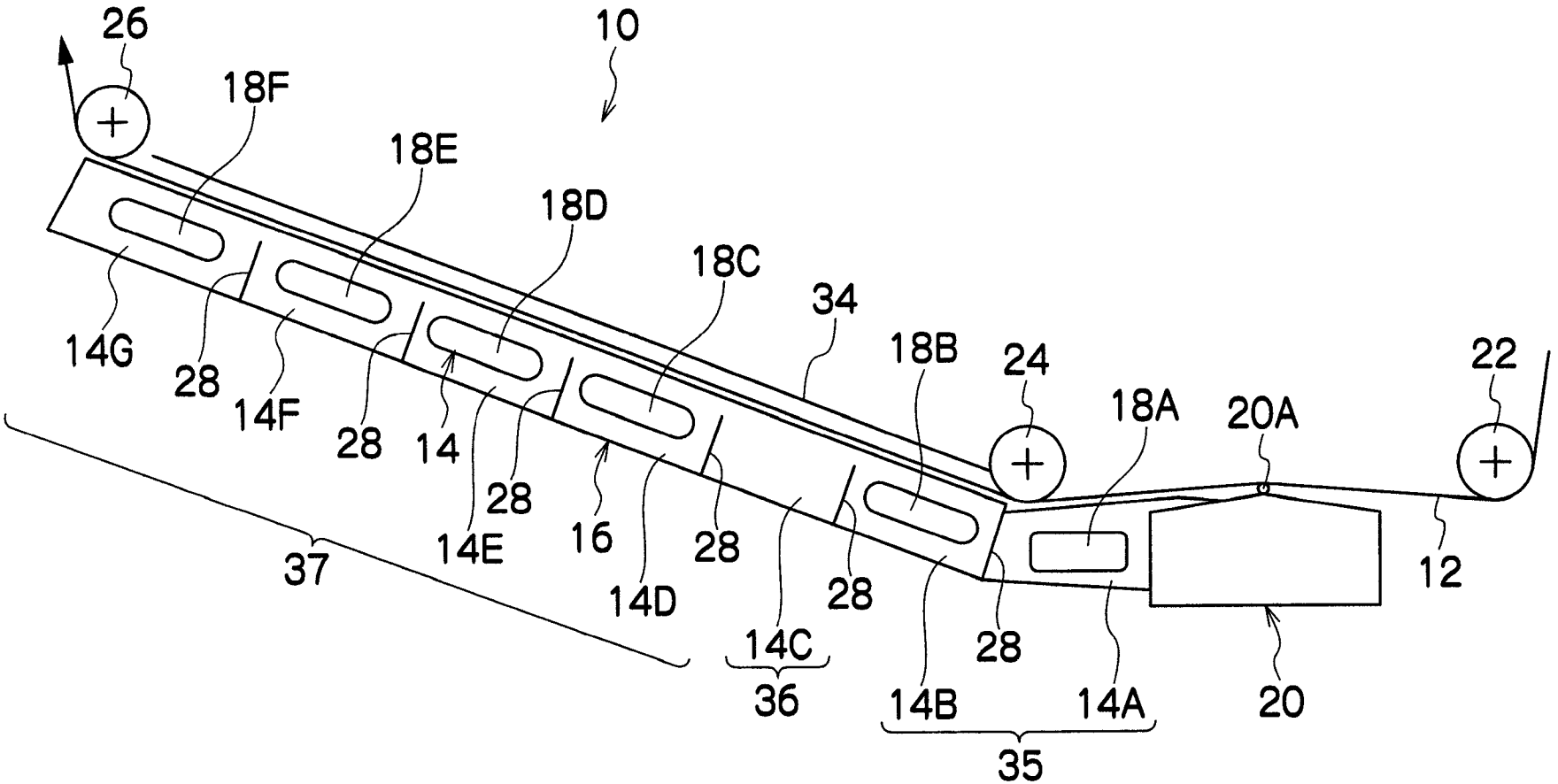
FIG. 1 is a side elevational view of a drying apparatus of the present invention.
Figure 2:
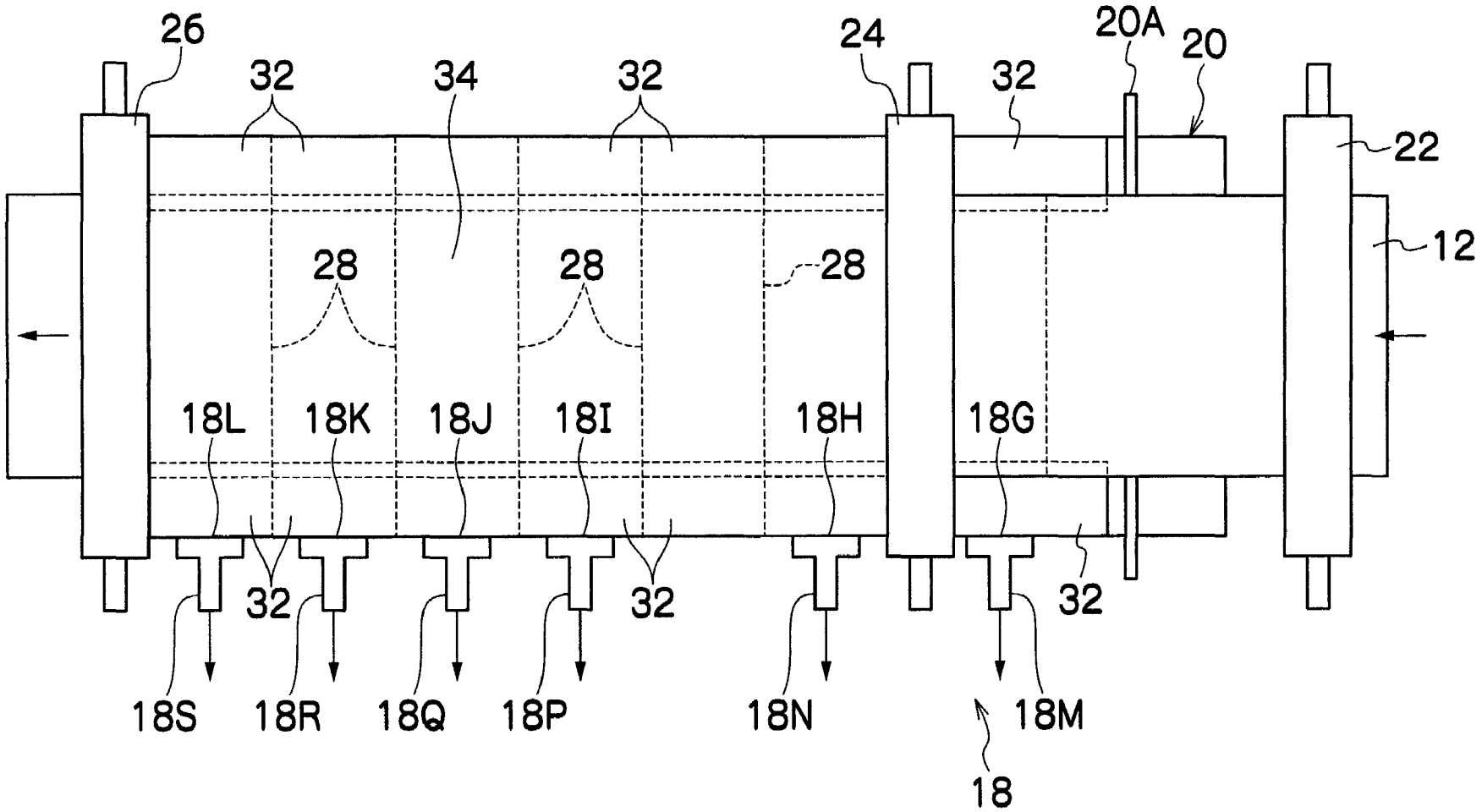
FIG. 2 is a plan view of the drying apparatus of the present invention.

FIG. 1 is a side elevational view of a drying apparatus of the present invention and FIG. 2 is a plan view overviewing FIG. 1 from upward.

As shown in FIGS. 1 and 2, the drying apparatus 10 for a coated film of the present invention is essentially composed of a main drying apparatus 16 which forms a drying zone 14 wherein the drying step for the coated film is carried out by passing a traveling continuous support 12 (hereinafter referred to "web 12"); the first drying wind zone 35 formed at former half of the drying zone 14 and having one-way air flow generating device 18's for generating a drying wind flowing from one edge side to another edge side in a width direction of the web 12; a windless zone 36 which does not supply the drying wind; and the second drying wind zone 37 formed at latter half of the drying zone 14 and having one-way air flow generating device 18's for generating a drying wind flowing from one edge side to another edge side in a width direction of the web 12. Further, the drying zone 14 is divided into the first drying wind zone 35, a windless zone 36 and the second drying wind zone 37 by means of partition boards 28's. Moreover, the drying apparatus 10 is installed just after a coating device 20 for applying a coating liquid containing an organic solvent over a traveling web 12.

Additionally, a term "windless zone" is defined as a zone into where no drying wind is supplied in the present invention. Because a line moves when the coating is carried out, wind accompanying the web generates in a traveling direction of the web, however, when the drying wind is not supplied, the drying zone is called as "windless zone" in the present invention. Although a wind velocity of 0.1 n/s or weaker may be detected when the wind velocity in the windless zone is measured by means of an anemometer during the line stops, such a zone may be called as the "windless zone" in the present invention even though the wind velocity is detected.

With regard to the coating device 20, for example, a bar coater equipped with a wirebar 20A is employable, and the coating liquid is applied onto a lower surface of the web 12 traveling while being supported by back up rollers 22, 24 and 26 thereby forming a coated film.

The main drying apparatus 16 is disposed immediately after the coating device 20, being formed as a long rectangle box shape installed along the surface of the coated film side of the web 12 (under surface side of the web), and a side of the surface of the coated film (upper side of the box body) among the each side of the box body is removed by cut. As a result, the drying zone 14 surrounding the coated film side to be dried of the traveling web 12 is formed. The drying zone 14 is divided into divisional zones 14A, 14B, 14C, 14D, 14E, 14 F and 14G (seven divisional zones in the present embodiment) by partitioning the main drying apparatus 16 with partition boards 28's that are perpendicular to the traveling direction of the web 12. Additionally, the divisional zones 14A and 14B constitute the first drying wind zone 35, the divisional zone 14C constitutes the windless zone 36 and the divisional zones 14D to 14G constitute the second drying wind zone 37 in the embodiment. In this case, the distance between the upper ends of the partition boards 28's dividing the drying zone 14 and the surface of the coated film formed over the web 12 is preferably in the range of from 0.5 to 12 mm, more preferably in the range of from 1 to 10 mm. Further, the one-way air flow generating device 18's (see FIG. 2) are disposed in both the first drying wind zone 35 and the second drying wind zone 37. Additionally, even in the windless zone, because the drying steps of the present invention are executable when no wind is supplied in the zone, the one-way airflow generating device may be disposed in the windless zone. Furthermore, although two divisional zones 14A and 14B are defined as the first drying wind zone 35, subsequent one divisional zone 14C is defined as the windless zone 36, and subsequent four divisional zones 14D to 14G are defined as the second drying wind zone 37 in the present embodiment, the deployment or constitution of the drying apparatus is appropriately modifiable depending on the kind of the coating liquid or the easiness of drying, etc.

The one-way air flow generating device 18's are mainly constituted by suction vents 18A, 18B, 18C, 18D, 18E and 18F that are formed on one side edge among both side edges of the main drying apparatus 16, exhaust vents 18G, 18H, 18I, 18J, 18K and 18L that are formed on the other side edge opposing to the suction vents 18A to 18F, and exhaust devices 18M, 18N, 18P, 18Q, 18R and 18S connected to the exhaust vents 18G to 18L. In accordance with the above structure, the air suctioned from the suction vents 18A to 18F into the divisional zones 14A, 14B and 14D to 14G are exhausted from the exhaust vents 18G to 18L by driving the exhaust devices 18M to 18S, resultantly generating the drying wind flowing into each divisional zones 14A, 14B and 14D to 14G in one-way from one edge side (suction vents side) to another edge side (exhaust vents side) in a width direction of the web 12. Further, because each divisional zones 14A to 14G are divided by the partition boards 28's, any drying wind in each divisional zone should be never supplied into the other divisional zone. Accordingly, the air supplied in one divisional zone will be exhausted from the same divisional zone and as a result, drying wind is supplied in one direction. Furthermore, the one-way air flow generating devices 18's have mechanisms capable of individually controlling the amount of exhaust air from each divisional zone 14A, 14B and 14D to 14G with the use of exhaust devices 18M to 18S.

With regards to the drying wind suctioned from the suction vents 18A to 18F, an air conditioning wind whose temperature and humidity are air-conditioned is preferable.

The length of the first drying wind zone 35 is preferably from 80 mm to 1600 mm, and more preferably from 50 mm to 200 mm both in a traveling direction of the continuous support. Further, the length of the windless zone 36 is preferably from 20 mm to 1000 mm, and more preferably from 100 mm to 500 mm both in a traveling direction of the continuous support.

Keeping the length of the first zone 35 within the above range will ensure executing the complete drying in the first drying step, resultantly suppressing the occurrences of the broad unevenness A. When the length is shorter than 80 mm, drying is incomplete and drying rate becomes slow. Further, when the length is longer than 1600 mm, the initial drying will finish among the first drying zone and the drying rate will become easily receiving an influence of wind resultantly allowing the occurrences of the broad unevenness A.

Furthermore, keeping the length of the windless zone 36 within the above range will enable to leave the drying rate of the coating liquid slow resultantly making it possible to position a drying status changing point where the drying status of the coated film changes from a constant rate drying period into a reducing rate drying period among the windless zone. When the length is shorter than 80 mm, it becomes difficult to position the drying status changing point among the windless zone, and when the length exceeds 1000 mm, a wind having a wind direction different from rubbing direction will generate by traveling of the web at the finishing stage of drying, resultantly allowing the occurrences of the sharp unevenness B.

Additionally, in a case where the first drying wind zone or the windless zone is formed with plural divisional zones, the length of each zone is defined as the sum of all the length of their divisional zones.

Further, the averaged wind velocity of the drying wind in the first drying step is preferably from 0.3 to 0.6 m/s, and is more preferably from 0.5 to 0.6 m/s. Keeping the averaged wind velocity of the drying wind in the first drying step within the above range will ensure executing the complete drying in the first drying step, resultantly suppressing the occurrences of the broad unevenness A. When the averaged wind velocity is slower than 0.3 m/s, drying is incomplete and drying rate becomes slow. Furthermore, when the averaged wind velocity is faster than 0.6 m/s, the drying status changing point will be positioned among the windless zone resultantly allowing the occurrences of the broad unevenness A.

Further, the averaged wind velocity of the drying wind in the second drying step is preferably from 0.1 to 0.3 m/s, and is more preferably from 0.1 to 0.15 m/s. At the finishing stage of drying, the sharp unevenness B will occur induced by a wind with a wind direction different from rubbing direction of the rubbing treatment subjected to the orientation film under the coated film. The occurrences of the sharp unevenness B is suppressible by supplying the drying wind weaker than the drying wind among the first drying step in a predetermined direction. Accordingly, it is preferable to supply the drying wind of within the above range.

Additionally, the average wind velocity in the present invention is obtainable by summing up the products of multiplying the absolute value of the wind velocity among each divisional zone and the length of the web among the divisional zone in the direction of conveyance, and dividing the total sum by the entire length of the corresponding zone.

By forming the drying apparatus in the structure that the width of the main drying apparatus 16 greater than the width of the web 12, a rectifying part covering open spaces in both sides of the drying zone 14 with rectifiable plates 32's is disposed. The rectifying part secures both the distance between the leading end of the coated film and the suction vents 18A to 18G and the distance between the trailing end of the coated film and the exhaust vents 18H to 18N, together with making the drying wind easily being suctioned into the drying zone 14 only through the suction vents 18A to 18G, thereby prohibiting a sudden drying wind flowing into the drying zone 14. The length of the rectifying part, i.e. the rectifiable plate 32 is preferably in the range of from 50 mm to 150 mm, both at the suction vent side and at the exhaust vent side.

Among the divisional zones 14A to 14G, it is important particularly for the divisional zone 14A nearest to the coating device that fresh air outside the drying zone 14 such as the above air conditioning wind hardly enter into the drying zone 14 immediately after the coating liquid is applied over the web 12. In order for realizing that, it is preferable that a constitution such that the web 12 as if covers the opening spaces of the divisional zone 14A by adjusting both the position of the wirebar 20A of the coating device 20 and the position of the back up roller 24 resultantly making the web 12 traveling closest to the divisional zone 14A, in addition to a deployment of the divisional zone 14A adjacent to the coating device 20 or to disposing of the above rectifiable plates 32's.

Further, at opposite side position of the main drying apparatus 16 sandwiching the web 12, a shielding plate 34 is disposed for the purpose that a stable traveling of the web 12 is not obstructed by the wind such as the above air conditioning wind, etc.

Next, an operating function of the drying apparatus 10 with the above constitution will be described.

Additionally, the web 12 has a layer of orientation film obtained by subjecting the rubbing treatment to previously coated resin for forming the orientation film, and the coating liquid will be explained later with embodiments of an organic solvent type coating liquid including a discotic liquid crystalline compound.

Immediately after the coating liquid is coated by means of the wire bar 20A in the coating device 20 over the web 12 traveling while being supported with back up rollers 22, 24 and 26, the initial drying of a surface of the coated film is executed by means of the drying apparatus 10. It is preferable to the initial drying that drying with the drying wind is started immediately after coating, started within 5 seconds after coating at the latest.

In the initial drying, the surface of the coated film immediately after the coating is in the situation of containing an organic solvent sufficiently, and a temperature distribution occurs in the surface of the coated film induced by a distribution of evaporation of the organic solvent (fluctuation) particularly during the initial drying immediately after the coating liquid with an organic solvent as the solvent is applied. The temperature distribution causes a distribution of surface tension, which further causes a flow of the coating liquid in the surface of the coated film, making the portion where the drying is slow in the coated film thin thereby occurring the broad unevenness A.

Because the broad unevenness disappears by fast drying, making the initial drying wind strong is effective for suppressing the unevenness. However, the inventors found that when no wind blows among the drying zone where the broad unevenness may be occurring, the broad unevenness never occurs on the contrary. The above finding is a reason why the windless zone is disposed in the present invention.

In other words, making the initial drying wind strong or never blowing wind among the drying zone enables to suppress the occurrences of the broad unevenness A. However, because the distribution of the drying rate expands at the drying status changing point, drying rate varies excitingly under the influence of the drying wind and as a result, the broad unevenness A will occur. Further, in a case where the drying process is executed without supplying any wind at all from the beginning, the drying time increases and the problem that production efficiency turns worse is not solved.

In order for evading the problem, making the wind among the drying zone corresponding to the drying status changing point windless and making the drying rate extremely slow enable to suppress the occurrences of the broad unevenness A.

Furthermore, although the orientation direction of the discotic liquid crystalline compound is decided by subjecting the rubbing treatment over the surface of the resin for forming the orientation film, winds in the cases of when the wind velocity of the different wind direction from the rubbing direction in the initial drying is fast, when winds join, when swirling wind occurs or so hit upon the surface of the coated film will cause shear of orientation direction partially in the surface of the coated film, which makes an origin of the sharp unevenness B. Accordingly, it is important that blowing a weak wind in an extent of causing no occurrence of any sharp unevenness after the web passed through the drying zone where the broad unevenness will occur. That is an effect of drying by supplying the wind again just at the time when the whole film became to the reducing rate drying period from the constant rate drying period.

From the above reasons, in order to prevent the unevenness A and B over the surface of the coated film in the initial drying, it is important that during the initial drying after coating and until the flow of the coated liquid in the surface of the coated film stops, non-uniform external wind is prohibited from hitting upon the coated film together with the concentration of organic solvent in the neighborhood of the surface of the coated film is always kept constant.

Figure 4:
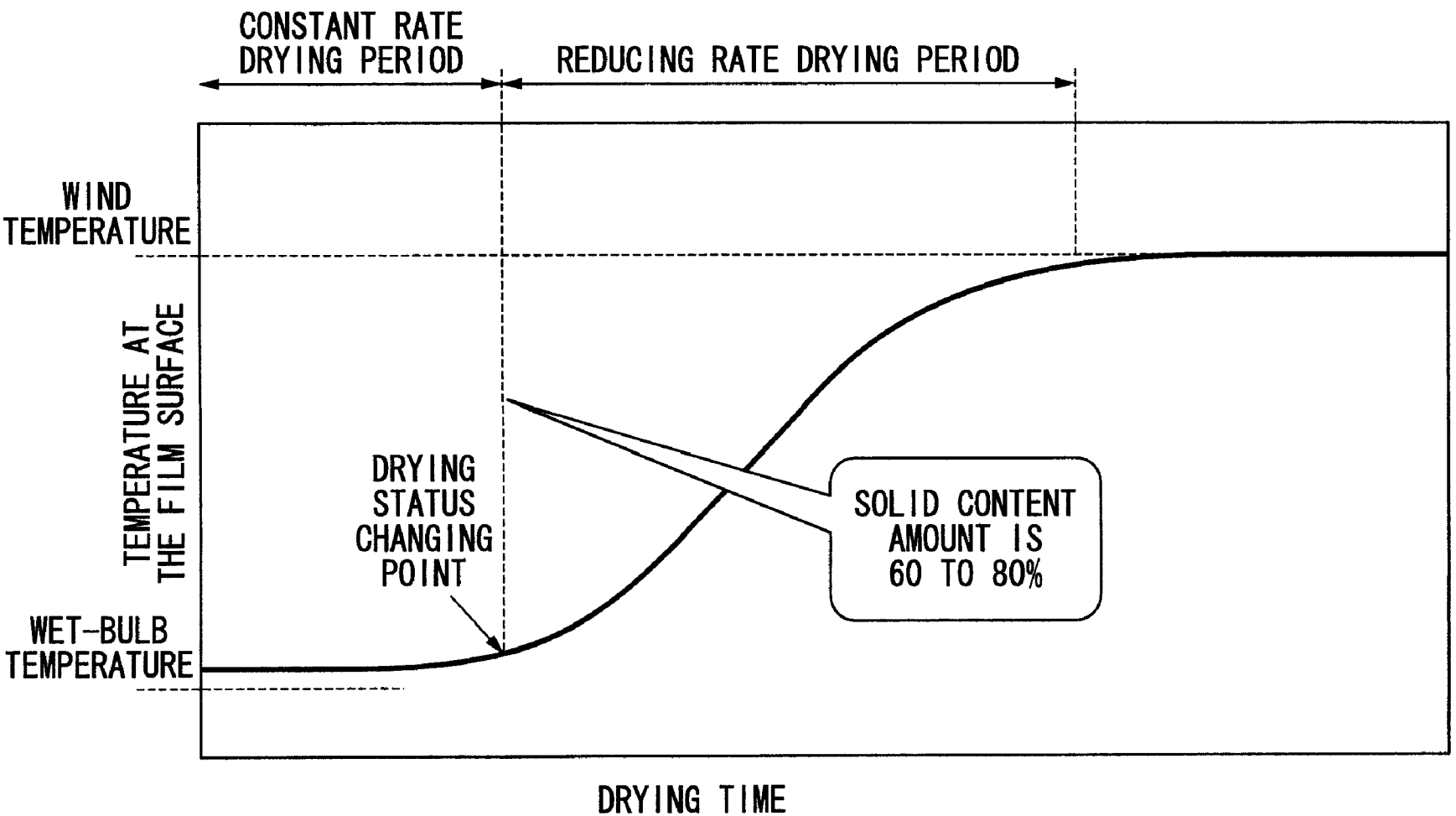
FIG. 4 is a drawing that shows a relation between a drying time and a temperature change of a surface temperature of the film.

Then, an explanation about the drying period will be described. Detailed explanation is described in drying chapter of Chemical Engineering Handbook. A relation between a drying time and a temperature change of a surface temperature of the film is illustrated in FIG. 4. In FIG. 4, the axis of abscissa expresses the drying time and the axis of ordinate expresses the surface temperature of the film. In a case where the coated film is dried with constant wind velocity and wind temperature, the temperature at the surface of the film being wet-bulb temperature elevates from a certain time as shown in FIG. 4. The period before the temperature elevates is called as the constant rate drying period, and while it is wet-bulb temperature, a migration of volatile content in the film is early enough, being in the situation that there are fluid volatilizing from the surface sufficiently exists.

However, in the reducing rate drying period during which the temperature starts to elevate, the volatile content in the film becomes scarce and a situation where the drying rate is slow happens even if the same wind is supplied. The drying status changing point as a critical point is a point where an amount of the solid contents becomes 60 to 80%.

The amount of solid contents in the present invention is calculated by:

The amount of solid contents (%)=solid contents/(volatile content+solid contents)×100

The solid contents and (volatile content+ solid contents) are required after weight measurement, using the following formulae (1) and (2):

Solid content=[*A*:weight of the film after completing the drying]−[*B*:*weight of the support before coating*] (1)

Volatile content+solid content=[*C*:weight of the film sampled among a certain drying zone]−[*B*:weight of the support before coating] (2)

Accordingly, when a sample is gotten in a certain zone, by measuring A: a weight after being completely dried under a temperature of boiling point of the volatile content, B: a weight after removing the film layer A, and C: a weight soon after sampling respectively, the solid content should be obtained. When the solid contents were measured about the samples among the windless zone under the conditions of Examples in the present invention, it was found that the measured values were within the range of from 60 to 80%.

Generally, the web 12 employed in the present invention has a width of 0.5 to 5 m, a length of 45 to 10000 m and a thickness of 5 to 200 μm. Examples include plastic films such as polyethylene telephthalate, polyethylene-2,6 naphthalate, cellulose diacetate, cellulose triacetate, cellulose acetate propionate, polyvinyl chloride, polyvinylidene chloride, polycarbonate, polyimide, polyamide, etc.; paper only; paper, metal foil such as aluminum, copper, tin and so on over which α-polyolefins having 2 to 10 carbon atoms such as polyethylene, polypropylene, ethylenebutene copolymer, or so is coated; or those supports made by forming a preparatory processing layer over the surface of a continuous substrate. Further, examples of the web 12 include those supports made by applying optical compensation film coating liquid, magnetic coating liquid, photographic photosensitive coating liquid, surface protective antistatic coating liquid or slipping agent coating liquid or so over the surface, drying, cutting and slitting into predetermined length and width. Typical examples include optical compensation film, various photographic films, photographic paper, magnetic tape, etc.

As a coating process of the coating liquid, a curtain coating process, an extrusion coating process, a roller coating process, a dip coating process, a spin coating process, a printing coating process, a spray coating process and a slide coating process may be employable other than the aforementioned bar coating process. In particular, the bar coating process, the extrusion coating process and the slide coating process are preferably employed.

Moreover, the number of the coated layer of the coating liquid to be simultaneously applied in the present invention is not limited to single layer and a simultaneous multilayer coating process may be adopted depending on its necessity.

[Coating Liquid]

Subsequently, an explanation about the coating liquid employed in the present invention will be described. The coating liquid used for the drying method for a coated film in the present invention is employable without particularly limited. However, a surface tension ratio of the coating liquid measured at both 10 milliseconds and 1000 milliseconds after coating (surface tension at 10 milliseconds after coating/surface tension at 1000 milliseconds after coating) in accordance with a maximum bubble pressure method is preferably from 1.00 to 1.20 when a product of C times F is from 0.05 to 0.12 wherein C represents a concentration of the polymer containing fluoro aliphatic group in the coating liquid with a unit of % by mass and wherein F represents a fluorine content in the polymer containing fluoro aliphatic group with a unit of %. Because a leveling property of the coating liquid is improvable by adjusting surface tension of the coating liquid appropriately, settling the surface tension ratio within the above range will provide an optimum optical anisotropic layer.

In other words, when the above surface tension ratio is greater than 1.20, a migration speed immediately after coating of the coated liquid towards air interface is slow and the stability of the coated surface is inferior, and as a result, an effect of reducing unevenness at the initial drying is not sufficient. When the surface tension ratio is within the range of from 1.00 to 1.20, the unevenness at the initial drying will be alleviated without the above disadvantage.

An amount of the content of the polymer containing fluoro aliphatic group in the present invention among the coating composition (coating constituent except solvent) being mainly a liquid crystal compound is preferably within the range of from 0.05 to 1% by mass, and more preferably within the range of from 0.1 to 0.5% by mass. When the addition amount of the polymer containing fluoro aliphatic group is less than 0.05% by mass, the effect of improving the leveling property is insufficient. Further, when the addition amount exceeds 1% by mass, an adverse influence against the performance as the optical film (e.g., uniformity of retardation, etc.) may be induced.

Further, the inventors found that the surface tension of the coating liquid relates greatly with a chemical structure of the polymer containing fluoro aliphatic group added to the coating liquid, specifically with a terminal structure of at least one of the monomer containing fluoro aliphatic group constituting the polymer containing fluoro aliphatic group.

That is, by changing the terminal structure of the monomer containing fluoro aliphatic group constituting the polymer containing fluoro aliphatic group from conventional $—(CF_2CF_2)_nH$ to $—(CF_2CF_2)_nF$, the surface tension of the coating liquid containing much organic solvent can be decreased. Additionally, n is preferably 2 to 4, and is more preferably 2 or 3.

Furthermore, it is more preferable that the terminal structure of the monomer containing fluoro aliphatic group is copolymer composing of both the first monomer containing fluoro aliphatic group corresponding to $—(CF_2CF_2)_3F$ and the second monomer containing fluoro aliphatic group corresponding to $—(CF_2CF_2)_2F$.

Additionally, regarding with the part aside from the terminal structure in the polymer containing fluoro aliphatic group, various kinds of repetition unit may be employable without particularly specified.

Next, an explanation about the fluorine polymer will be described. The fluorine polymer which is preferably employed in the drying method of the present invention is a polymer containing a fluoro aliphatic group having at least one kind of a repeating unit introduced from a monomer of poly(oxyalkylene)acrylate and/or poly(oxyalkylene)methacrylate and at least one kind of a repeating unit introduced from a monomer containing fluoro aliphatic group represented by a following chemical formula (general formula) (1):

Chemical Formula (1)

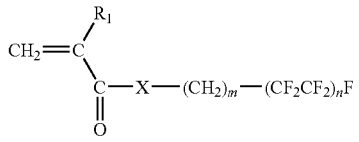

In the chemical formula (general formula) (1), $R_1$ represents a hydrogen atom or a methyl group, X represents an oxygen atom, sulfur atom or —N($R_2$)—, m represents an integer of 1 to 6, and n represents an integer of 2 to 4. $R_2$ represents a hydrogen atom or an alkyl group having 1 to 4 carbon atoms, specifically a methyl group, an ethyl group, a propyl group or a butyl group, preferably a hydrogen atom or a methyl group. It is preferable that X represents an oxygen atom.

In the chemical formula (general formula) (1), m is preferably an integer of 1 to 6, and in particular, m preferably corresponds to 2. Further, n represents an integer of 2 to 4, preferably 2 or 3, and a mixture compound of the above polymers may be employed.

Next, an explanation about the poly(oxyalkylene)acrylate and/or poly(oxyalkylene)methacrylate which is the other component composing the polymer having fluoro aliphatic group will be described (hereinafter, meaning both acrylate and methacrylate will be occasionally referred to as (metha) acrylate combining both of them).

A polyoxyalkylene group may be expressed as $(OR)_x$, wherein R represents an alkylene group having 2 to 4 carbon atom, for example, it preferably represents —$CH_2CH_2$—, —$CH_2CH_2CH_2$—, —$CH(CH_3)CH_2$— or —$CH(CH_3)CH(CH_3)$—.

An oxyalkylene unit in the poly(oxyalkylene) group may be the same with each each other as in poly(oxypropylene), and may be the unit formed by irregularly distributing two or more kinds of oxyalkylene different from each other. It may be either a straight-chain or a branched oxypropylene or oxyethylene unit, and may be existing as a block of either a straight-chain or a branched oxypropylene unit and a block of either a straight-chain or a branched oxyethylene unit.

The poly(oxyalkylene) chain may include a chain formed by connecting plural poly(oxyalkylene) units with one or more linkage bond (for example, —CONH-Ph-NHCO—, —S— and so on wherein Ph represents a phenylene group). In a case where the linkage bond has valences of 3 or more, it provides means for obtaining an oxyalkylene unit of a branched-chain. Further, when the copolymer is employed in the present invention, molecular weight of the poly(oxyalkylene) group is appropriately from 250 to 3000.

Poly(oxyalkylene)acrylate and methacrylate can be prepared by reacting commercially available hydroxypoly(oxyalkylene) material including "Pluronic" (Trade name, available from ADEKA CORPORATION), "ADEKA Polyether" (Trade name, available from ADEKA CORPORATION), "Carbowax" (Trade name, available from ADEKA CORPORATION), "Triton" (Trade name, available from Rohm and Haas and "P.E.G" (Trade name, available from Dai-ichi Kogyo Seiyaku Co., Ltd.) as examples with acrylic acid, methacrylic acid, acryl chloride, methacryl chloride, anhydrous acrylic acid or so by publicly known process. Moreover, separately from those, poly(oxyalkylene)diacrylate prepared by publicly known process and so on may be employable.

As one embodiment of the polymer containing fluoro aliphatic group used in the present invention, a copolymer of both a monomer containing fluoro aliphatic group and polyoxyalkylene(metha)acrylate represented by the chemical formula (general formula) (1) is used.

As a preferable embodiment of the polymer containing fluoro aliphatic group used in the present invention, a copolymer represented by the chemical formula (general formula) (1) and comprises the first monomer containing fluoro aliphatic group whose terminal structure is expressed with —$(CF_2CF_2)_3F$, the second monomer containing fluoro aliphatic group whose terminal structure is expressed with —$(CF_2CF_2)_2F$ and polyoxyalkylene (metha)acrylate is used.

In this case, a total amount of the monomer containing fluoro aliphatic group represented by the chemical formula (general formula) (1) in the polymer containing fluoro aliphatic group is preferably 20 to 50% by mass based on the total amount of the monomer composing the polymer containing fluoro aliphatic group, and is more preferably around 40% by mass.

Further, it is preferable that (the first monomer containing fluoro aliphatic group)/(the first monomer containing fluoro aliphatic group+the second monomer containing fluoro aliphatic group) is 20 to 80% by mass.

An amount of the monomer containing fluoro aliphatic group represented by the chemical formula (general formula) (1) in the polymer containing fluoro aliphatic group of the present invention is preferably 5 to 60% by mass based on the total amount of the monomer composing the polymer containing fluoro aliphatic group, and is more preferably around 35 to 45% by mass.

An amount of poly(oxyalkylene)acrylate and/or poly(oxyalkylene)methacrylate is preferably 40 to 95% by mass based on the total amount of the monomer composing the above polymer containing fluoro aliphatic group, and is more preferably 55 to 65% by mass.

A weight average molecular weight of the polymer containing fluoro aliphatic group used in the present invention is preferably 3000 to 100000, and is more preferably 6000 to 80000.

The polymer containing fluoro aliphatic group used in the present invention can be prepared by the process of publicly known common use. For example, the polymer can be prepared by adding a general purpose radical polymerization initiator into an organic solvent having a monomer such as (metha)acrylate containing the above fluoro aliphatic group, (metha)acrylate having a polyoxyalkylene group, etc., and polymerizing the resultant solution. Moreover, depending on the situation, further adding other addition polymerization property unsaturated compound, the same procedure as the above is applicable. A drip polymerization method in which a polymerization is carried out while dripping a monomer and an initiator into a reaction container depending on the polymerization property of each monomer is effective for obtaining the polymer with a uniform composition.

Next, an explanation about the material for the coating liquid aside from the polymer containing fluoro aliphatic group will be described.

(Compound Having Liquid Crystalline Property)

As the compound having liquid crystalline property, azomethines, azoxys, cyanobiphenyls, cyanophenyl esters, benzoates, cyclohexanecarboxylic acid phenyl esters, cyanophenyl cyclohexanes, cyano substituted phenylpyrimidines, alkoxy substituted phenylpyrimidines, phenyl dioxanes, thorons and alkenyl cyclohexyl benzonitriles are preferably used.

Additionally, a metal complex is also included in the compound having liquid crystalline property. Further, a liquid crystal polymer containing the compound having liquid crystalline property in its repeating unit is also employable as the compound having liquid crystalline property. In other words, the compound having liquid crystalline property may be bonded with a (liquid crystal) polymer.

(Discotic Liquid Crystalline Compound)

Examples of the discotic liquid crystalline compound include benzene derivatives described in C. Destrade et al. (Mol. Cryst. vol. 71, pp. 111, 1981), truxene derivatives described in C. Destrade et al. (Mol. Cryst. vol. 122, pp. 141, 1985, Physics lett. A, vol. 78, pp. 82, 1990), cyclohexane derivatives described in B. Kohne et al. (Angew. Chem. vol. 96, pp. 70, 1984), macrocyclic compounds of azacrown-type or phenylacetylene-type described in J. M. Lehn et al. (J. C. S., Chem. Commun., pp. 1794, 1985, and J. Zhang et al. (J. Am. Chem. Soc. vol. 116, pp. 2655, 1994).

In the composition for forming the optically anisotropic layer, arbitrary additives may be jointly applicable in addition to the above compound having liquid crystalline property and the above polymer containing fluoro aliphatic group. Examples of the additives include a repelling inhibitor, additives for controlling a tilt angle (tilt angle of the compound having liquid crystalline property at an interface of optically anisotropic layer/orientation film) of the orientation film, a polymerization initiator, additives for decreasing orientation temperature (plasticizer), a polymerizational monomer and polymer, a surfactant, etc.

(Repelling Inhibitor)

In order to prevent a repelling in coating, a repelling inhibitor is usable together with the compound having liquid crystalline property, particularly with the discotic liquid crystalline compound. Any polymer compound (polymer) having compatibility with the compound having liquid crystalline property and without furiously obstructing the tilt angle variation or the orientation of the compound having liquid crystalline property is usable as the repelling inhibitor being not particularly restricted.

Examples of the polymer employable as the repelling inhibitor are described in Japanese Patent Application Laid-Open No. 8-95030, and concrete examples of particularly preferable polymer include cellulose esters. Typical examples of the cellulose ester include cellulose acetate, cellulose acetate propionate, hydroxypropylcellulose and cellulose acetate butylate. An addition amount of the polymer usable as the repelling inhibitor is, in a viewpoint of not obstructing the orientation of the compound having liquid crystalline property, generally and preferably within the range of from 0.1 to 10% by mass based on the compound having liquid crystalline property, more preferably within the range of from 0.1 to 8% by mass and further more preferably within the range of from 0.1 to 5% by mass.

(Orientation Film Side Inclination Angle Control Agent)

A compound having both a polar group and a nonpolar group in its molecules can be added in the optically anisotropic layer as additives controlling an inclination angle of the surface in orientation film side.

Examples of the polar group include R—OH, R—COOH, R—O—R, R—$NH_2$, R—NH—R, R—SH, R—S—R, R—CO—R, R—COO—R, R—CONH—R, R—CONHCO—R, R—$SO_3$H, R—$SO_3$—R, R—$SO_2$NH—R, R—$SO_2$NH$SO_2$—R, R—C═N—R, HO—P(—R)$_2$, (HO—)$_2$P—R, P(—R)$_3$, HO—PO(—R)$_2$, (HO—)$_2$PO—R, PO(—R)$_3$, R—$NO_2$, R—CN, etc. Further, organic salt (for example, ammonium salt, pyridinium salt, carboxylate, sulfonate, phosphate) is applicable.

As the polar group, R—OH, R—COOH, R—O—R, R—$NH_2$, R—$SO_3$H, HO—PO(—R)$_2$, (HO—)$_2$PO—R, PO(—R)$_3$ or organic salt is preferable. In the above descriptions, R contained in the polar groups represents a nonpolar group, for example, including the following nonpolar groups.

Examples of the nonpolar group include alkyl group [preferably straight-chain, branched or circular substituted or unsubstituted alkyl group having 1 to 30 carbon atoms] alkenyl group [preferably straight-chain, branched or circular substituted or unsubstituted alkenyl group having 1 to 30 carbon atoms], alkynyl group [preferably straight-chain, branched or circular substituted or unsubstituted alkenyl group having 1 to 30 carbon atoms], aryl group [preferably substituted or unsubstituted aryl group having 6 to 30 carbon atoms] and silyl group [preferably substituted or unsubstituted silyl group having 3 to 30 carbon atoms].

Those nonpolar groups further may have a substituent, and examples of the substituent include halogen atom, alkyl group (including cycloalkyl group and bicyclo alkyl group), alkenyl group (including cycloalkenyl group and bicycloalkenyl group), alkynyl group, aryl group, heterocyclic group, cyano group, hydroxyl group, nitro group, carboxyl group, alkoxy group, aryloxy group, silyloxy group, heterocyclic oxy group, acyloxy group, carbamoyloxy group, carbalkoxy oxy group, aryloxycarbonyl oxy group, amino group (including anilino group), acylamino group, aminocarbonylamino group, alkoxycarbonylamino group, aryloxy carbonylamino group, sulfamoylamino group, alkylsulfonylamino group, arylsulfonylamino group, sulfhydryl group, alkylthio group, arylthio group, heterocyclic thio group, sulfamoyl group, sulfo group, alkylsulfinyl group, arylsulfinyl group, alkylsulfonyl group, arylsulfonyl group, acyl group, aryloxycarbonyl group, alkoxycarbonyl group, carbamoyl group, arylazo group, heterocyclic azo group, imido group, phosphino group, phosphinyl group, phosphinyloxy group, phosphinylamino group, silyl group, etc.

Further, the orientation film tilt control agent can be added in a composition for forming an optically anisotropic layer. Making molecules of the compound having liquid crystalline property under the existence of the orientation film tilt control agent has capability of adjusting tilt angle of molecules having liquid crystalline property in an orientation film side interface. A variant of the tilt angle in this occasion relates to rubbing density. When the orientation film with high rubbing density and the orientation film with low rubbing density are compared, although the addition amounts of the orientation film tilt control agent are equal, the tilt angle of the orientation film with low rubbing density is easily variable. Accordingly, despite the fluctuation depending on rubbing density, dimension of desired tilt angle and so on, a recommended range of the addition amount of the orientation film tilt control agent is preferably from 0.0001 to 30% by mass based on the mass of the compound having liquid crystalline property, more preferably from 0.001 to 20% by mass, and further more preferably from 0.005 to 10% by mass. Additionally, the tilt angle is defined as an angle between longitudinal direction of the molecule in the compound having liquid crystalline property and a normal of an interface (orientation film interface or air interface).

(Polymerization Initiator)

It is preferable to form the optically anisotropic layer by fixing the molecules of the compound having liquid crystalline property to an oriented state. Utilizing a polymerization reaction is preferable as a method for fixing the oriented state. A thermal polymerization reaction using a thermal polymerization initiator and a photopolymerization reaction using photopolymerization reaction initiator are included in the polymerization reaction, however, the photopolymerization reaction is preferable for preventing the support or so from both deformation and quality change caused by heat.

Examples of the photopolymerization initiator include α-carbonyl compound (described in U.S. Pat. Nos. 2,367,661 and 2,367,670), acyloinether (described in U.S. Pat. No. 2,448,828), α-hydrocarbon substituted aromatic acyloin compound (described in U.S. Pat. No. 2,722,512), multinucleated quinone compound (described in U.S. Pat. Nos. 3,046,127 and 2,951,758), triaryl imidazoledimer and p-aminophenylketone (described in U.S. Pat. No. 3,549,367), acridine and phenazine compound (described in Japanese Patent Application Laid-Open No. 60-105667 and U.S. Pat. No. 4,239,850) and oxadiazole compound (described in U.S. Pat. No. 4,212,970).

A use amount of the photopolymerization initiator is preferably in the range of from 0.01 to 20% by mass, more preferably in the range of from 0.5 to 5% by mass based on the solid contents of the coating liquid. It is preferable that ultraviolet ray is employed in light irradiation for polymerizing the liquid crystalline molecules.

The irradiation energy is preferably in the range of from 20 $mJ/cm^2$ to 50 $J/cm^2$, more preferably in the range of from 20 $mJ/cm^2$ to 5000 $mJ/cm^2$, and further more preferably in the range of from 100 $mJ/cm^2$ to 800 $mJ/cm^2$. Further, in order to promote photopolymerization reaction, the light irradiation may be carried out under heating condition. A protective layer may be disposed over the optically anisotropic layer.

(Polymerizable Monomer)

In the composition for forming the optically anisotropic layer, a polymerizable monomer may be included together with the compound having liquid crystalline property. As the polymerizable monomer which can be employed in the present invention, there is no restriction so long as it is compatible with the compound having liquid crystalline property and has properties of not causing a tilt angle variation or not inhibiting orientation of the compound having liquid crystalline property remarkably. Preferred compounds have ethyleny unsaturated groups with polymerization activity including, for example, a vinyl group, a vinyloxy group, an acryloyl group, a methacryloyl group, etc. The polymerizable monomer is added generally in the amount of 1 to 50% by mass, preferably in an amount of 5 to 30% by mass based on an amount of the compound having liquid crystalline property. Further, it is particularly preferable to employ a monomer having 2 or more reactive functional groups because an effect of raising adhesion between the orientation film and the optically anisotropic layer can be expected.

(Polymer)

Although a polymer containing fluoro aliphatic group related to the present invention is included in the composition for forming the optically anisotropic layer, other polymer may be further used together with the discotic liquid crystalline compound.

As the polymer, it is preferable that the polymer has compatibility to some extent with the discotic liquid crystalline compound and that the polymer is capable of giving change of the inclination angle to the discotic liquid crystalline compound. Typical example of such a polymer is cellulose ester. Preferable examples of the cellulose ester include cellulose acetate, cellulose acetate propionate, hydroxypropylcellulose and cellulose acetate butylate.

In order for not disturbing the orientation of the discotic liquid crystalline compound, an addition amount of the above polymer is preferably within the range of from 0.1 to 10% by mass, more preferably within the range of from 0.1 to 8% by mass, further more preferably within the range of from 0.1 to 5% by mass respectively based on the discotic liquid crystalline compound. The transition temperature of from discotic nematic liquid crystal phase to solid phase of the discotic liquid crystalline compound is preferably in the range of from 70 to 300° C., and more preferably in the range of from 70 to 170° C.

(Solvent for Coating)

A composition for forming the optically anisotropic layer can be prepared into the coating liquid. As the solvent employable in preparation of the coating liquid, organic solvents are preferable.

Examples of the organic solvent include amide (example: N,N-dimethylformamide), sulfoxide (example: dimethylsulfoxide), heterocyclic compound (example: pyridine), hydrocarbon (examples: benzene, hexane), alkyl halide (examples: chloroform, dichloro-methane), ester (examples: methyl acetate, butyl acetate), ketone (examples: acetone, butanone) and ether (examples: tetrahydrofuran, 1,2-dimethoxyethane). Among those, alkyl halide and ketone are preferable. Two or more kinds of the organic solvent are jointly applicable.

(Coated Film)

In the coated film formed by the drying method of the present invention, a fluorine atom existing ratio (F/C) of the coated film measured in accordance with ESCA method at a position of 10 nm in a depth direction from an air interface of the coated film is preferably from 2 to 10 in a case where the fluorine atom existing ratio (F/C) is defined as 100 at the air interface. A coated film with superior appearance characteristic can be formed when fluorine concentration is increased at the surface of the coated film, and further, by entering fluorine even among the coated film.

EXAMPLES

Substantial effects of the present invention will be explained by reference to the following examples.

Examination Example 1

Drying Apparatus

Drying steps were conducted by means of the drying apparatus in the present invention while blowing drying wind with wind velocities of 0.2 to 0.7 m/s and under conditions of Examples 1 to 11 and Comparative Examples 1 to 5 in the tables, followed by evaluating occurrences of unevenness in coated films. As for the wind velocity, it was measured about the greatest value while rotating an anemometer 360 degrees in a state of stopping the process line.

Figure 3:
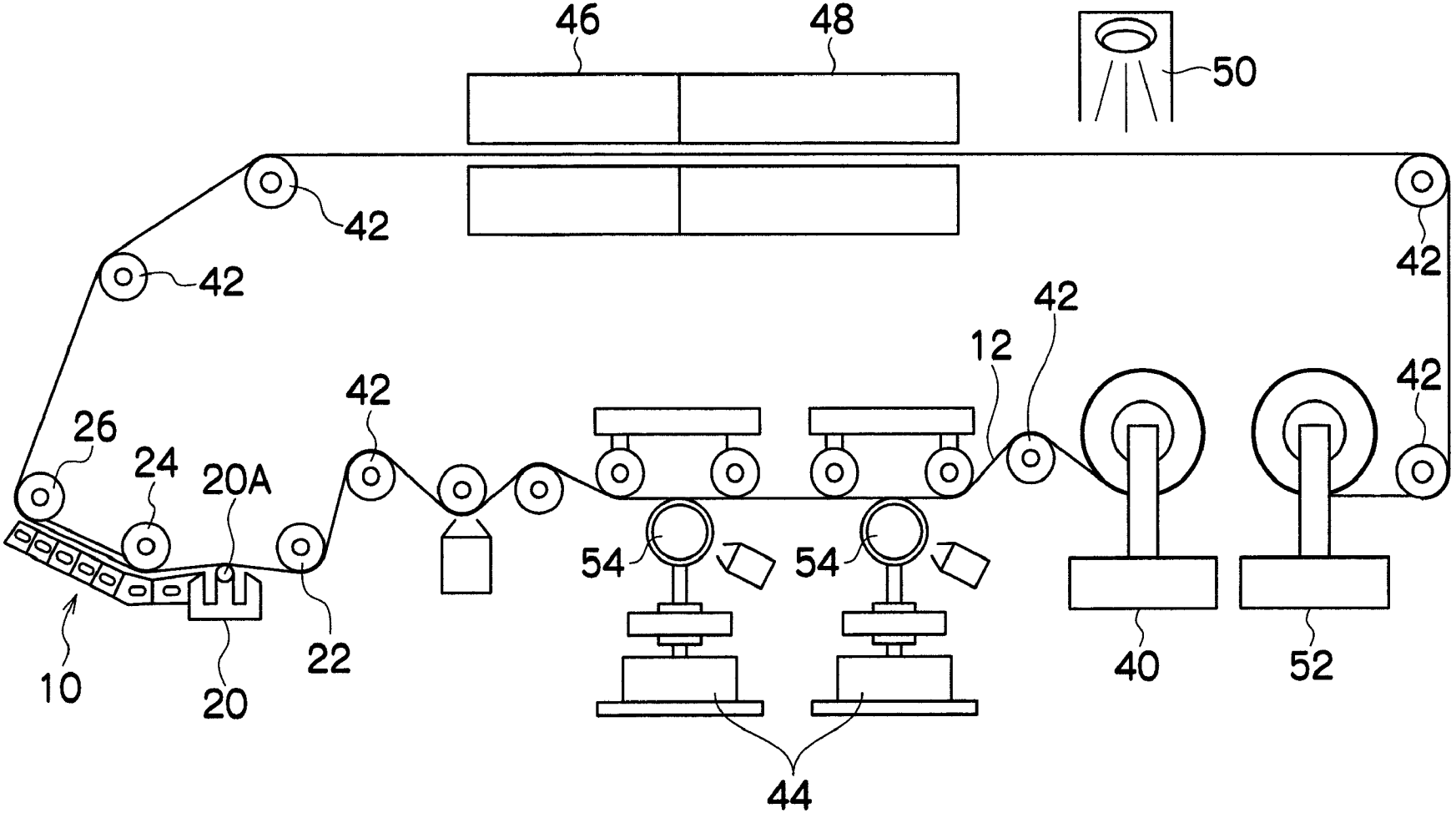

In the beginning, a process for the preparation of the optical compensation film will be described. As shown in FIG. 3, a web 12 fed from a delivery device 40 passes through a rubbing treatment equipment 44, a coating device 20, a drying apparatus 10 for an initial drying of the present invention, a drying zone 46 for regular drying, a heating zone 48 and a ultraviolet ray lamp 50 while being supported by plural guide rollers 42's, followed by being wound up by means of a rewinder 52.

With regard to the web 12, triacetylcellulose film (Trade name: Fujitac, available from Fuji Photo Film Co., Ltd.) having a thickness 80 μm was employed. Further, over the surface of the web 12, a 2% by weight solution of long-chain alkyl modified Poval (MP-203, available from Kuraray Co., Ltd.) was coated in an amount of 25 ml per $m^2$, followed by drying at 60° C. for 1 minute, thereby forming a resin layer for an orientation film. The resultant web 12 traveled while being conveyed at a traveling speed of 30 m/minute, and the surface of the resin layer was subjected to a rubbing treatment to form an orientation film.

And then, as the coating liquid for applying over the orientation film obtained by subjecting the rubbing treatment to a resin layer for orientation film, a coating liquid containing the compound having liquid crystalline property which is a 40% by weight methylethylketone solution of a mixture made by adding 1% by weight of photopolymerization initiator (IRGACURE 907, available from Ciba Geigy Japan Co., Ltd.) into a mixture of discotic compounds TE-8 (3) and TE-8 (5) with a weight ratio of 4:1 was employed. While conveying the resultant web 12 with traveling speed of 30 m/minute, the coating liquid was applied by means of the wirebar 20A over the orientation film in a manner that the coating amount becomes 5 ml to 7 ml per $m^2$. Then, an initial drying was carried out by means of the drying apparatus 10 just after the coating.

Further, a space between upper ends of partition boards 28's dividing the drying zone 14 into seven sections and a surface of the coated film was settled within a range of from 5 to 9 mm. Moreover, regarding with the web 12 initially dried by means of the drying apparatus 10, it was conveyed through the drying zone 46 adjusted at 100° C. and the heating zone 48 adjusted at 130° C. to form a nematic phase. Subsequently, while continually conveying the resultant web 12 after applying the orientation film and a compound having liquid crystalline property, an ultraviolet ray irradiation was performed by means of a ultraviolet lamp 50 over the surface of the liquid crystal layer.

Figure 5B:
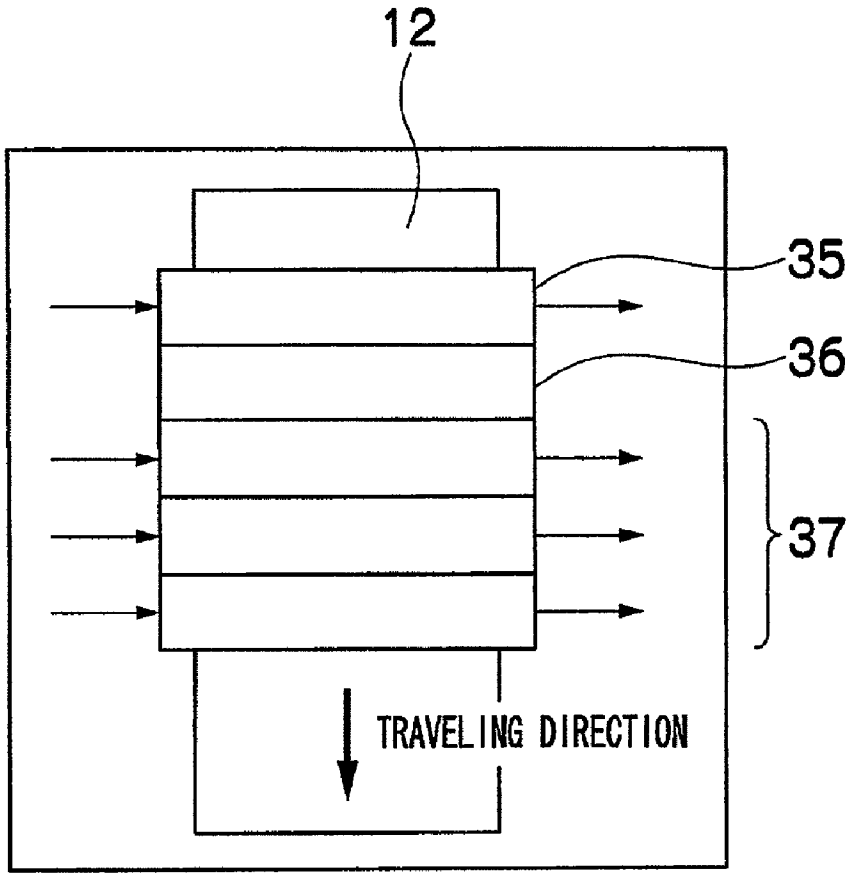
FIG. 5B is a drawing that shows a wind direction of the drying wind in a drying apparatus of the present invention.
Figure 5A:
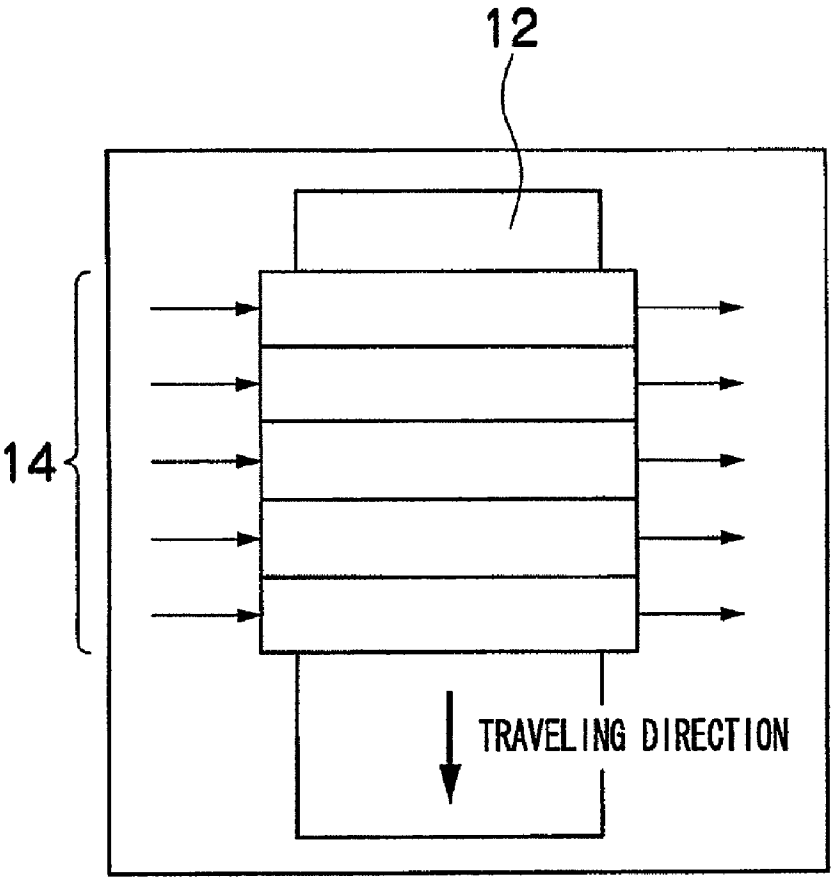
FIG. 5A is a drawing that shows a wind direction of the drying wind in a conventional drying apparatus.
Figure 10:
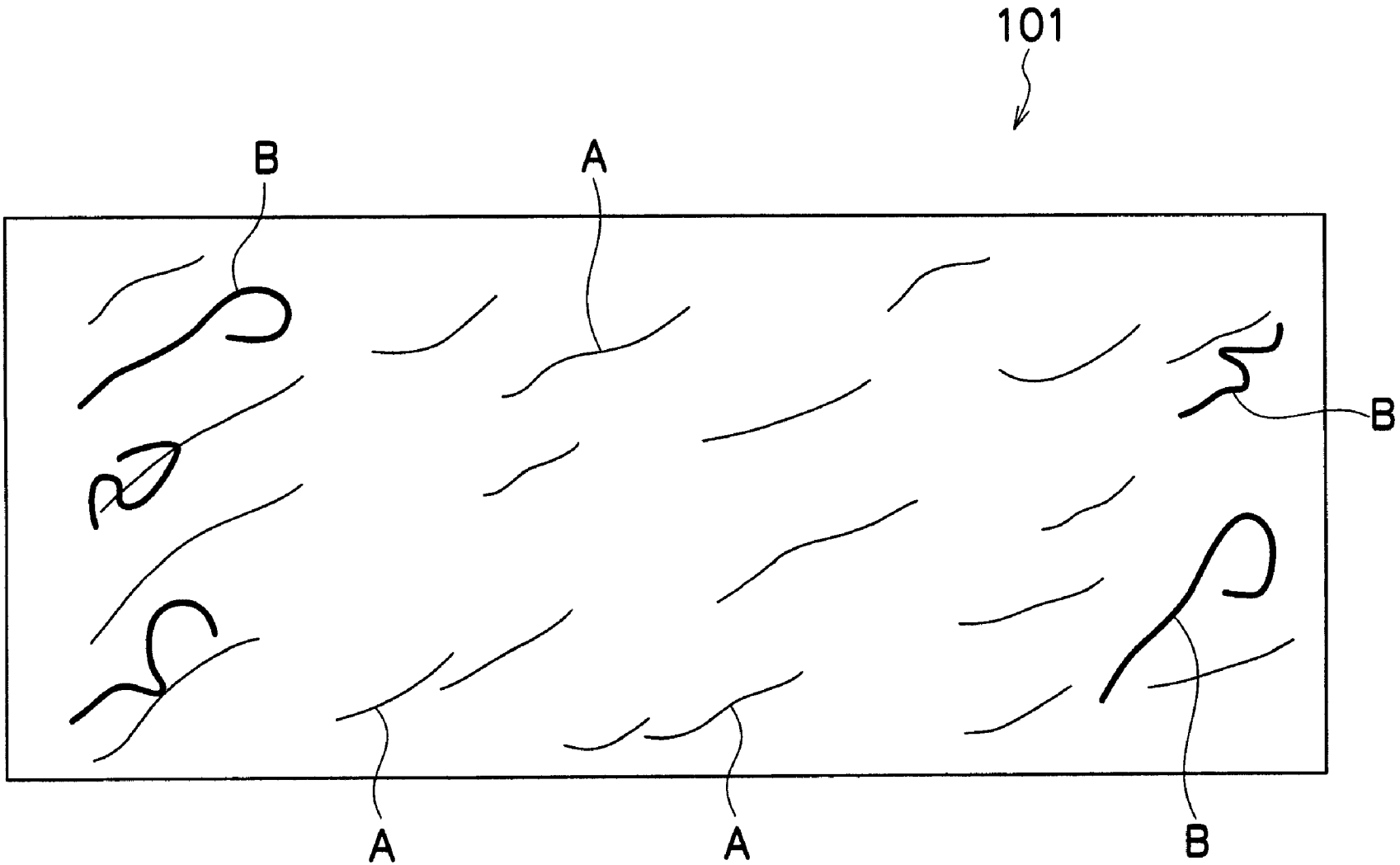
FIG. 10 is a drawing that shows the situation of occurrences of the unevenness (mottles) in the conventional drying process.
Figure 11:
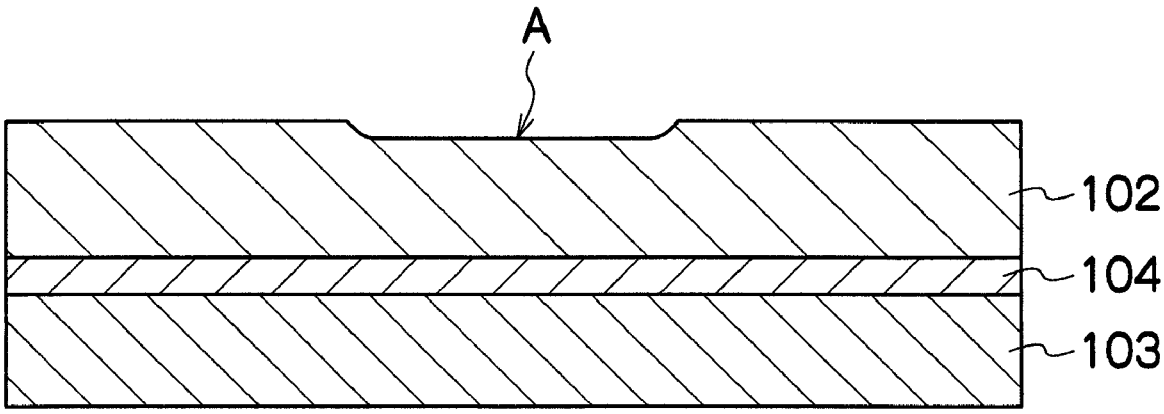
FIG. 11 is an explanatory drawing illustrating the broad unevenness (mottles)
Figure 12:
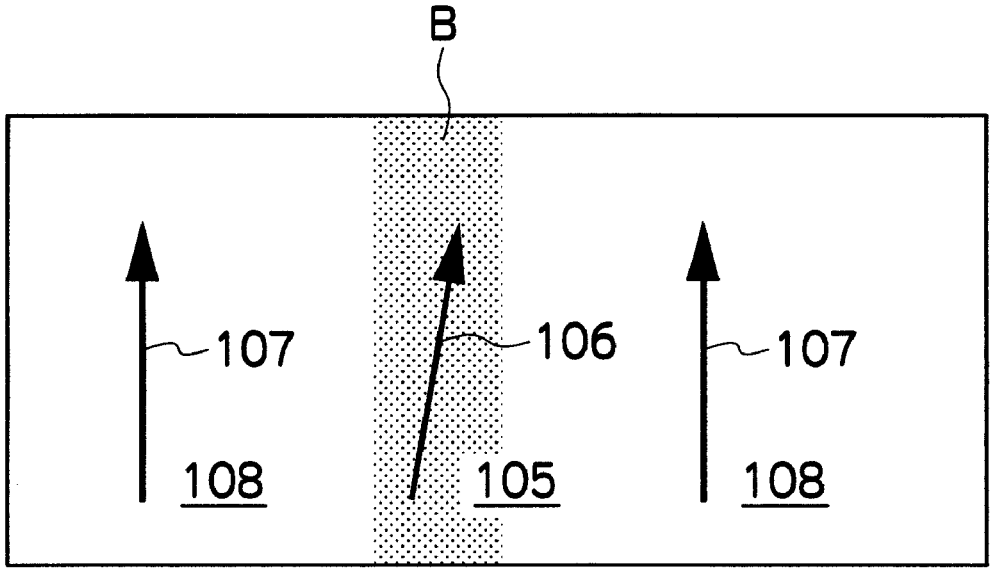
FIG. 12 is an explanatory drawing illustrating the sharp unevenness (mottles).

Wind direction in the drying apparatus 10 is shown in FIG. 5A illustrates the wind direction among a conventional drying apparatus. FIG. 5B illustrates the wind direction of the drying wind among the drying apparatus in the present invention. As shown in the figures, the drying apparatus in the present invention has a constitution such that a windless zone is disposed subsequent to the first drying wind ventilation zone and then, the second drying wind ventilation zone is disposed after the windless zone.

The results are described in FIG. 6. Additionally, following criteria was adopted about occurrences of unevenness and over-all evaluation in FIG. 6.

(Occurrences of Unevenness)

AA: No unevenness occurred.

BB: Although a slight unevenness occurred, it was with a level of no problem in quality.

CC: Occurrences of unevenness were found.

(Total Evaluation)

AA: Permissible as product and with extremely favorable surface situation.

BB: Permissible as product.

CC: Not permissible as product.

Resultantly as can be seen from FIG. 6, because wind was supplied when a drying status of the coated film changes from a constant rate drying period into a reducing rate drying period in the Comparative Example 1 without disposing the windless zone, a distribution revealed in drying rate so that a broad unevenness occurred. Further, although no wind was supplied in Example 5 with a long windless zone, the web traveled and accordingly, wind generated in a traveling direction of the web so that a sharp unevenness occurred slightly. Both in Example 8 wherein the first drying wind zone was long and in Example 12 wherein the wind velocity in the first drying wind zone was fast, because the drying rate in the first drying step was also fast, sharp unevenness occurred slightly caused by the subsequent drying wind in the first drying step. Moreover, in Example 10 wherein the wind velocity of the drying wind in the first drying step was weak, a uniform drying was not achieved because the supply of the drying wind was insufficient and accordingly, broad unevenness was recognized slightly.

From the above result, it was confirmed that by disposing the windless zone after the first drying zone, occurrences of both the broad unevenness and the sharp unevenness could be suppressed. Further, by carrying out the drying steps with appropriate ranges of the length of the drying zone and of the wind velocity of the drying wind, the coating film of better quality was obtainable.

Examination Example 2

Coating Liquid (Surface Tension)

Coating liquids were prepared by the usage of compositions described in FIG. 7 and dissolving them into methylethylketone. As the discotic liquid crystalline compound, the following discotic liquid crystalline compound (1) was employed. Further, the coating liquids were prepared employing the following compounds (P-0) to (P-4) as the polymers containing fluoro aliphatic group.

[Discotic Crystalline Compound (1)]

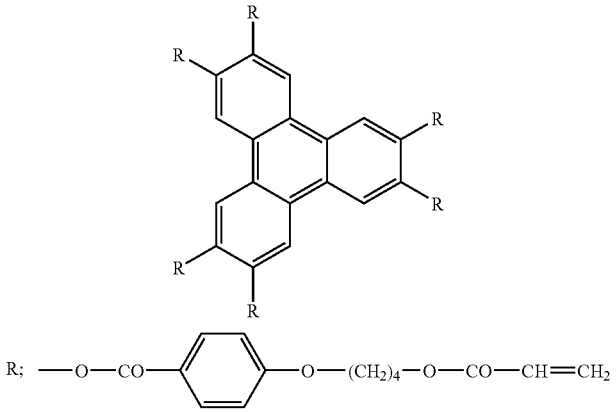

[Compound (P-0): Monomer containing acidic group]

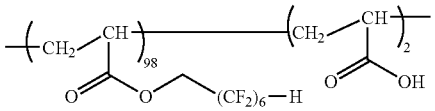

[Compound (P-1): ωHC6 type polymer]

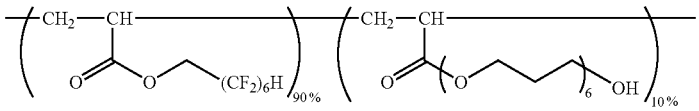

[Compound (P-2): ωFC6 type polymer]

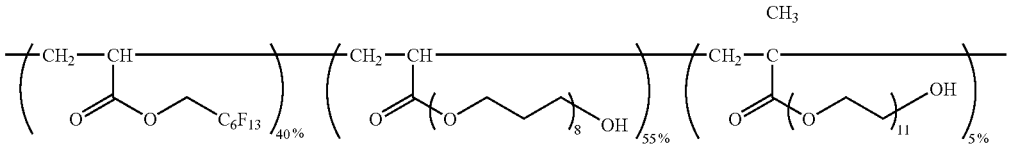

[Compound (P-3): ωF(C6 + C4) type polymer]

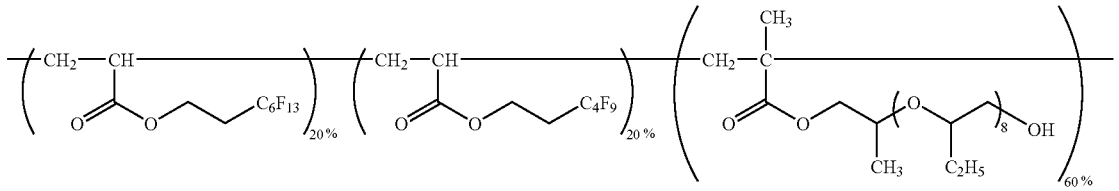

[Compound (P-4): ωF(C6 + C4) type polymer]

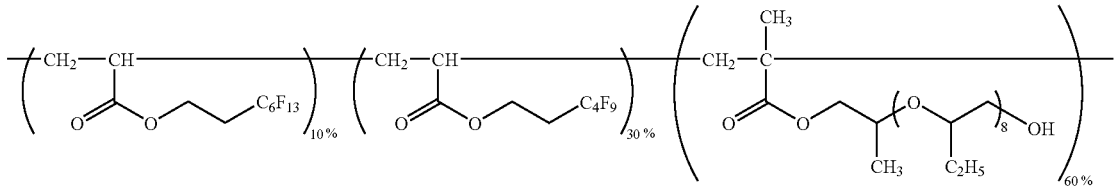

As thus described, the coating liquids each different in composition of polymers or so containing fluoro aliphatic group were coated with an extrusion coating process (E type) over transparent support. Then, relations between a time-lapse variation of surface tension of the coating liquid immediately after the coating and an appearance characteristic were evaluated.

The surface tension of the coating liquid was measured in accordance with a maximum bubble pressure method by means of a dynamic surface tension measuring instrument (MPT2: manufactured by LAUDA). In the method, pouring a specified amount of the coating liquid having a polymer containing fluoro aliphatic group into a beaker, and blowing up a bubble by ejecting nitrogen gas from a capillary inserted into the beaker, the surface tension was decided from the maximum pressure in an occasion of widening an interface between the liquid and the gas. The results are shown in FIG. 8.

As shown in FIG. 8, in Examples 16 and 17 wherein ωF(C4+C6) type polymer was used as a polymer containing fluoro aliphatic group, surface tensions were smaller from the time immediately after coating than Comparative Examples 2, 4 and 5 wherein ωFC4 type polymer or ωFC6 type polymer was used alone. Further, in Examples 16 and 17, surface tension ratio (surface tension after 10 milliseconds/surface tension after 1000 milliseconds) was as small as 1.1 $mN/m^2$ as described in FIG. 8.

From the above result, it is understood that in Examples 16 and 17 wherein ωF(C4+C6) type polymer was used as a polymer containing fluoro aliphatic group, an adsorption rate of air interface immediately after coating is faster than Comparative Example 2, 4 and 5 wherein ωFC4 type polymer or ωFC6 type polymer was used singly, and further, that in Examples 16 and 17, an effect of stabilizing the surface of the coated film was superior to Examples 2, 4 and 5. By the facts, it is understood that the present invention enables to prevent unevenness defects occurring by the initial drying and to enhance appearance characteristic of the optical film.

Further, it was understood that in Comparative Example 3 wherein ωH type polymer was used as a polymer containing fluoro aliphatic group, the surface tension immediately after coating was small and adsorption rate of air interface is fast, however, an air interface stabilization effect was poor and the appearance characteristic was inferior because H group exists partially in ωH type polymer. Moreover, as a result of having carried out similar tests about a bar coating process, similar tendency was obtained.

Examination Example 3

Coating Liquid (Fluorine Atom Existing Ratio)

By means of drying apparatus of the present invention and employing coating liquids of Example 16 and Comparative Examples 2 and 3, formation and drying the coated film were carried out. Regarding with a formation condition of the coated film, while conveying the web with traveling speed of 30 m/minute, the examples were carried out in manners that the amount of coating liquids became 5 ml to 7 ml per $m^2$ of the web. Fluorine atom existing ratios after drying were measured in accordance with ESCA analysis (Electron Spectroscopy for Chemical Analysis). The results are described in FIG. 9. Further the fluorine concentration measured in accordance with ESCA analysis. In the measurement, JPS-9000MX manufactured by JEOL was used. Additionally, following criteria was adopted about appearance characteristic evaluation in FIG. 9.

(Fabrication of Polarizing Plate)

The optical film prepared was attached over one side of a polarizer with polymer substrate (TAC film) surface using polyvinylalcohol based adhesive. Further, executing saponification treatment onto triacetylcellulose film having a thickness of 80 μm (TD-80U: available from Fuji Photo Film Co., Ltd.), the film was attached to the other side (opposition side) of the polarizer using polyvinylalcohol based adhesive.

A light transmission axis of the polarizer and a retardation phase axis of the polymer substrate were disposed to be parallel with each other. The light transmission axis of the polarizer and a retardation phase axis of the above triacetylcellulose film were disposed to be perpendicular with each other. A polarizing plate was fabricated in a manner as the description.

(Unevenness Evaluation Over Flat High Brightness Light Source)

The fabricated polarizing plate was adhered over a flat high brightness light source (FP 901 high brightness flat light source manufactured by Gunma Ushio Inc.), and comparing with a level sample as a decision criteria; unevenness was evaluated by visual observation.

AA: Superior or equivalent to the level sample.

CC: Inferior to the level sample.

As a result, in Example 16 wherein the coating liquid having Compound (P-3) as the polymer containing fluoro aliphatic group was used, fluorine concentration in the coated film surface formed was 100% and further, fluorine was contained among the coated film thereby obtaining the coated film with favorable appearance characteristic. With regards to Comparative Example 2 using Compound (P-2) and Comparative Example 3 using Compound (P-1), the appearance characteristics were poor because fluorine existed only in the surface or because fluorine concentration among the surface was not 100%.

What is claimed is:

1. A drying method for a coated film formed by applying a coating liquid containing an organic solvent over a traveling continuous support, the method which sequentially conducts, immediately after the application, following steps in a drying zone where a coated surface to be dried of the traveling continuous support is surrounded:

a first drying step for drying the surface of the coated film by conveying the continuous support through a first drying wind zone in which an one-way flow drying wind, flowing from one edge side to another edge side in a width direction of the continuous support, is supplied;

a windless drying step for drying the surface of the coated film by conveying the continuous support through a windless drying zone in which the drying wind is not blown;

the windless drying step is conducted at a location where an amount of solids content among the coated film being dried in the drying zone is 60% to 80% by mass; and a second drying step for drying the surface of the coated film by conveying the continuous support through a second drying wind zone in which an one-way flow drying wind, flowing from one edge side to another edge side in a width direction of the continuous support, is supplied; wherein an averaged wind velocity of the drying wind in the first drying step is set faster than an average wind velocity of the drying wind in the second drying step.

2. The drying method for a coated film according to claim 1, wherein the windless drying step is conducted at a location encompassing a drying status changing point where a drying status of the coated film changes from a constant rate drying period into a reducing rate drying period.

3. The drying method according to claim 1, wherein a length of the first drying wind zone is from 80 to 1600 mm along the traveling direction of the continuous support, and wherein a length of the windless zone is from 20 to 1000 mm along the traveling direction of the continuous support.

4. The drying method for a coated film according to claim 1, wherein an averaged wind velocity of the drying wind in the first drying step is from 0.3 to 0.6 m/s, and wherein an averaged wind velocity of the drying wind in the second drying step is from 0.1 to 0.3 m/s.

5. The drying method for a coated film according to claim 1, wherein the coated film to be dried is a coated film formed by applying a coating liquid for a liquid crystal layer which is coated on an orientation film subjected to a rubbing treatment in a preparation process for an optical compensation film.

6. The drying method for a coated film according to claim 1, wherein the coating liquid contains a following polymer (i) containing fluoro aliphatic group with a repetition unit introduced from monomers, and wherein the polymer containing fluoro aliphatic group satisfies the following condition (ii):

(i) a polymer which comprises a first monomer containing fluoro aliphatic group whose terminal structure is expressed with —$(CF_2CF_2)_3F$ and a second monomer containing fluoro aliphatic group whose terminal structure is expressed with —$(CF_2CF_2)_2F$; and (ii) a surface tension ratio of the coating liquid measured at both 10 milliseconds and 1000 milliseconds after coating (surface tension at 10 milliseconds after coating/surface tension at 1000 milliseconds after coating) in accordance with a maximum bubble pressure method is from 1.00 to 1.20 when a product of C times F is from 0.05 to 0.12 wherein C represents a concentration of the polymer containing fluoro aliphatic group in the coating liquid with a unit of % by mass and wherein F represents a fluorine content in the polymer containing fluoro aliphatic group with a unit of % by mass.

7. The drying method for a coated film according to claim 6, wherein a fluorine atom existing ratio (F/C) of the coated film measured in accordance with ESCA method at a position of 10 nm in a depth direction from an air interface of the coated film is from 2 to 10 in a case where the fluorine atom existing ratio (F/C) is defined as 100 at the air interface.

8. The method of claim 1, wherein the first drying step, the windless drying step and the second drying step are performed in this order.

* * * * *